United States Patent [19]

Nakano et al.

[11] Patent Number: 4,473,006

[45] Date of Patent: Sep. 25, 1984

[54] SYSTEM FOR DISCRIMINATING AMONG DIFFERENT KINDS OF TYPE CARRIERS

[75] Inventors: Hiroshige Nakano; Tsuneki Kobayashi; Shigenobu Katagiri, all of Ibaragi, Japan

[73] Assignee: Hitachi Koki Company Limited, Tokyo, Japan

[21] Appl. No.: 964,111

[22] Filed: Nov. 27, 1978

[30] Foreign Application Priority Data

Nov. 26, 1977 [JP] Japan ..... 52-141874

[51] Int. Cl.[3] ..... B41J 1/20

[52] U.S. Cl. ..... 101/93.14; 101/111

[58] Field of Search ..... 101/93.14, 110, 111; 400/144.2, 144.3

[56] References Cited

U.S. PATENT DOCUMENTS

| | | | |
|---|---|---|---|
| 3,845,709 | 11/1974 | Gardiner | 101/111 X |
| 3,880,075 | 4/1975 | Bovett et al. | 101/111 |
| 3,899,968 | 8/1975 | McDevitt | 101/111 |
| 4,055,117 | 10/1977 | Munday | 101/111 X |
| 4,074,798 | 2/1978 | Berger | 400/144.3 |
| 4,152,981 | 5/1979 | Sapino et al. | 101/93.01 |

*Primary Examiner*—Edward M. Coven

*Attorney, Agent, or Firm*—Sughrue, Mion, Zinn, Macpeak, and Seas

[57] ABSTRACT

Systems for discriminating among a plurality of type carriers differing in number of characters and pitch of characters are disclosed. In one circuit, the type carrier is provided with synchronizing marks and discrimination marks in addition to the usual type character marks. The synchronizing mark is located at the beginning of a set of characters, and the discrimination mark is located a predetermined distance from the synchronizing mark according to the number of characters and pitch of the particular type carrier. This distance is determined by counting type character marks. In another circuit, one or more discrimination marks are provided between type character marks at the beginning of a set of characters. The number of discrimination marks indicates the number of characters of the particular type carrier. In either circuit, a counter of only a few stages and a simple decoding circuit are all that are required to carry out the discrimination operation.

1 Claim, 24 Drawing Figures

FOR USE IN GENERATING CHARACTER CODES
$2^0$ $2^1$ $2^2$ $2^3$
32
TYPE MARK COUNTER
CLK
CLR
33
REGISTER
TYPE MARK SIGNAL
SYNCHRONIZING
MARK SIGNAL
DISCRIMINATION MARK SIGNAL
34
DECODER
48 CHARACTER
64 CHARACTER
96 CHARACTER
128 CHARACTER
TYPE PITCH
31
MARK RECOGNIZING SIGNAL
MARK DETECTING SIGNAL
DISCRIMINATION MARK SIGNAL

SYSTEM FOR DISCRIMINATING AMONG DIFFERENT KINDS OF TYPE CARRIERS

BACKGROUND OF THE INVENTION

1. Field Of The Invention

The present invention relates generally to line printers with interchangeable type carriers and, more particularly, to a system for discriminating the kind of type carrier loaded on such a line printer.

2. Description Of The Prior Art

As is well known, there are a variety of type carriers, such as type belts, type trains and type drums. The present invention can be applied to all sorts of type carriers. However, for purposes of explanation, the present invention is described with reference to the type belt carrier.

As is well known in the art, type belts are classified according to the number of characters provided thereon, the distance between adjacent types (hereinafter referred to as "the type pitch"), the size of the types, and the type code. However, the present invention is described with reference to the number of characters on the type belt and, in one modification, to the type pitch.

In the case of a 48-character type belt, the type belt may have a plurality of type sets, each comprising 48 characters. On the type belt, type marks are provided below the respective types and a synchronizing mark indicating the beginning of the type set is also provided.

In order to discriminate the type belt being used, a method has been proposed where the number of characters between synchronizing marks is counted. However, such a discrimination method exhibits deficiencies in that the discrimination time is relatively long, it is necessary to provide a counter having a count capacity equal to or greater than the maximum number of characters, and the arrangement of the device to implement such a method is intricate. This method was disclosed in Mayo, R. F., "Print Element Character Set Status Logic", *IBM Technical Disclosure Bulletin,* Volume 16, No. 6, Nov. 1973, pp. 1937–1938.

Another method for discriminating the type belt being used is disclosed in U.S. Pat. No. 3,899,968 to McDevitt, issued Aug. 19, 1975. This method uses a plurality of synchronizing marks at the beginning of the character set on the type belt to provide an identification tag. The identification tag is read from the belt into a shift register and then provided to an identification register, whose output is compared in a comparator with the verification tag provided by a verification register. Printing is allowed to take place only when the verification tag is identical to the identification tag. This method exhibits deficiencies in that a considerable amount of logic circuitry is needed to provide the desired identification function due to the use of the relatively complex binary coded identification tag.

Other prior art methods which provide an indication of the beginning of the font of a type belt or type drum are found in, respectively, U.S. Pat. No. 3,875,545 to Curtiss, issued April 1, 1975, and U.S. Pat. No. 3,117,514 to Doersam, issued Jan. 14, 1964. However, neither of these systems disclose a type belt idenification capability.

SUMMARY OF THE INVENTION

Accordingly, an object of this invention is to eliminate the above-described difficulties accompanying the prior art, and to readily discriminate the kind of type carrier loaded on a line printer.

The specific feature of the invention resides in that a discrimination mark or discrimination marks specifying the kind of a type carrier are provided thereon, and the position of the discrimination mark or the number thereof, employed as discrimination factor, is detected to determine the kind of the type carrier.

DETAILED DESCRIPTION OF THE DRAWINGS

The foregoing and other objects, advantages and features of the invention will be better understood from the following detailed description with reference to the accompanying drawings, in which:

FIGS. 1(*a*)–1(*d*) are plan views of type belts of 48, 64, 96 and 128 characters, respectively, according to a first embodiment of the invention;

Figure 7A:
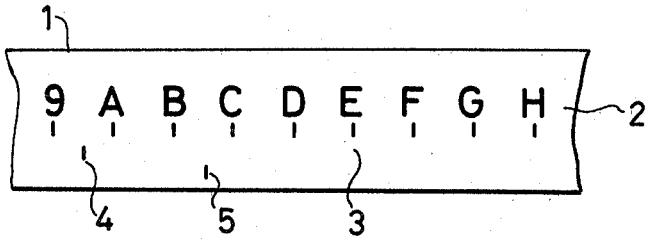
Figure 7B:
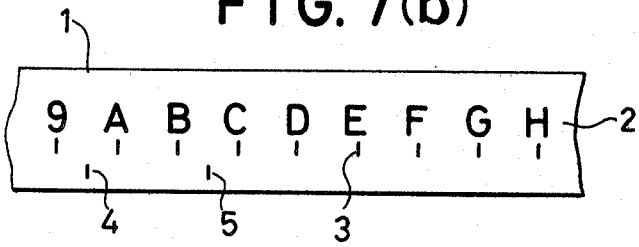
Figure 7C:
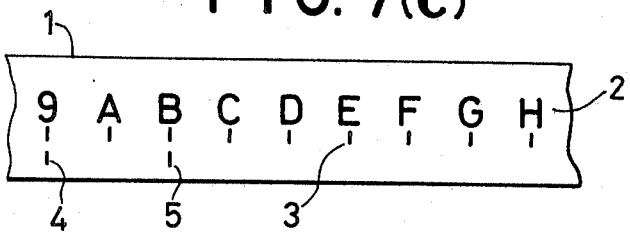
Figure 8A:
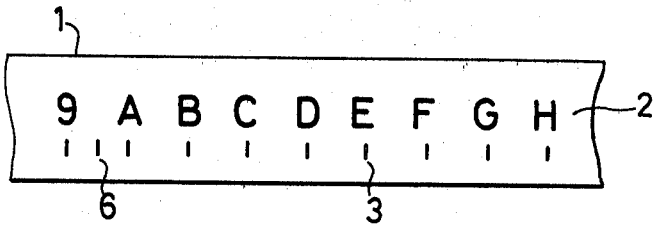
Figure 8B:
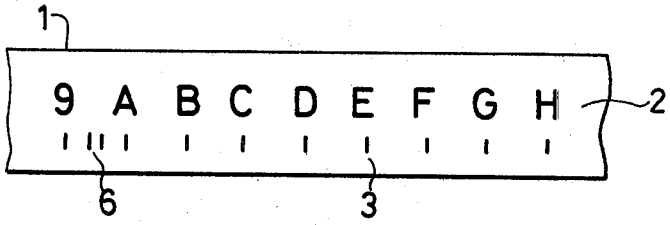
Figure 8C:
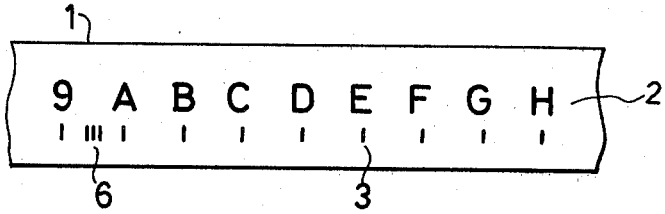
Figure 8D:
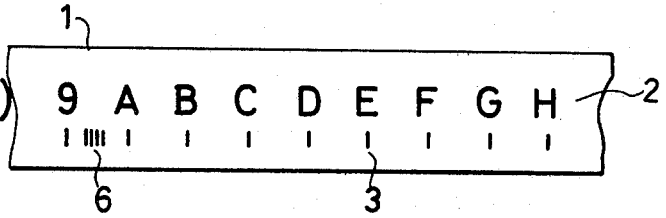
Figure 10:
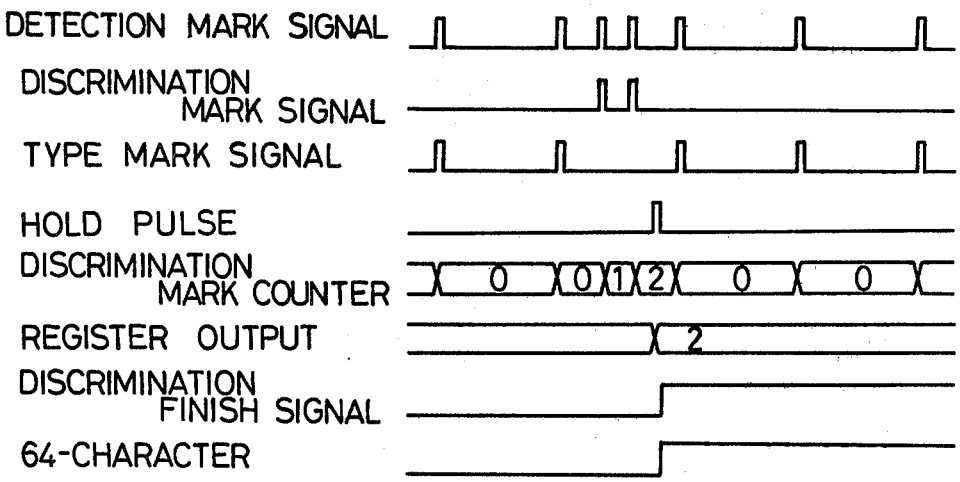
Figure 9:
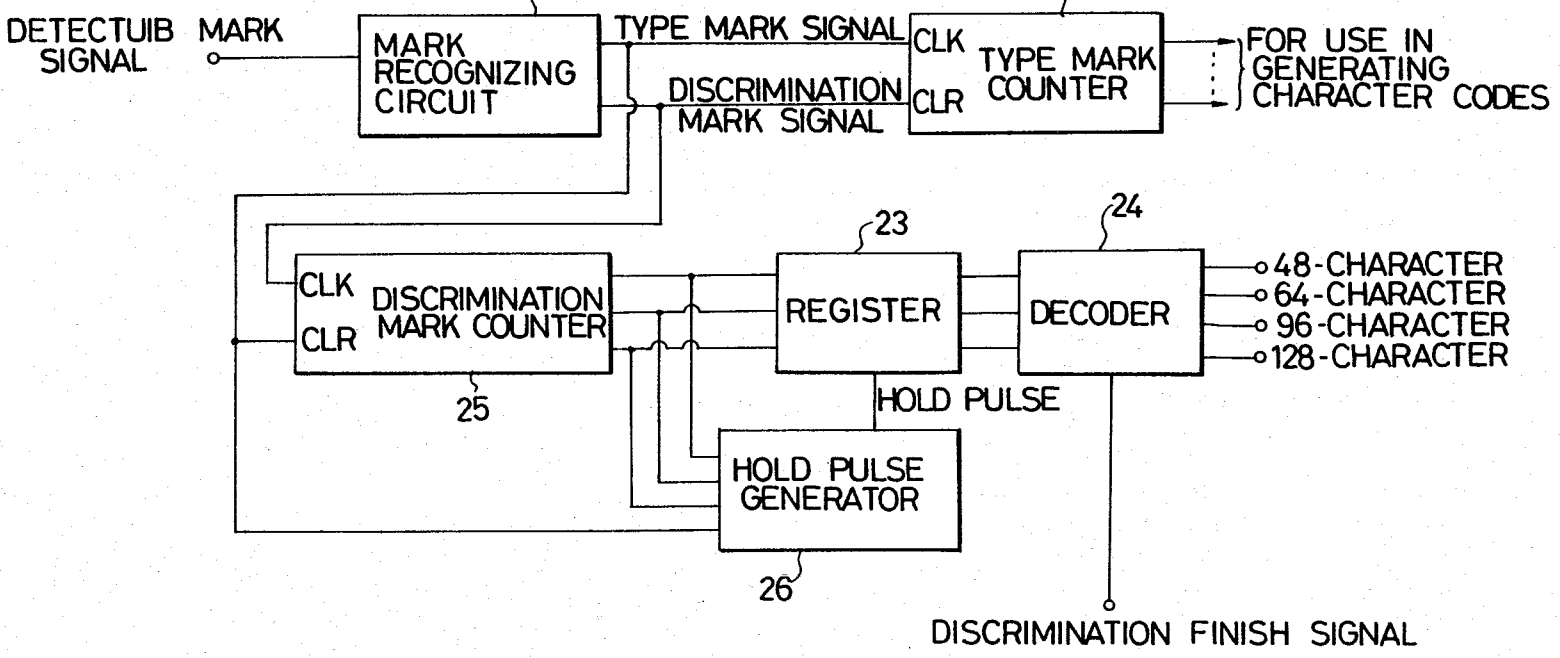
Figure 11:
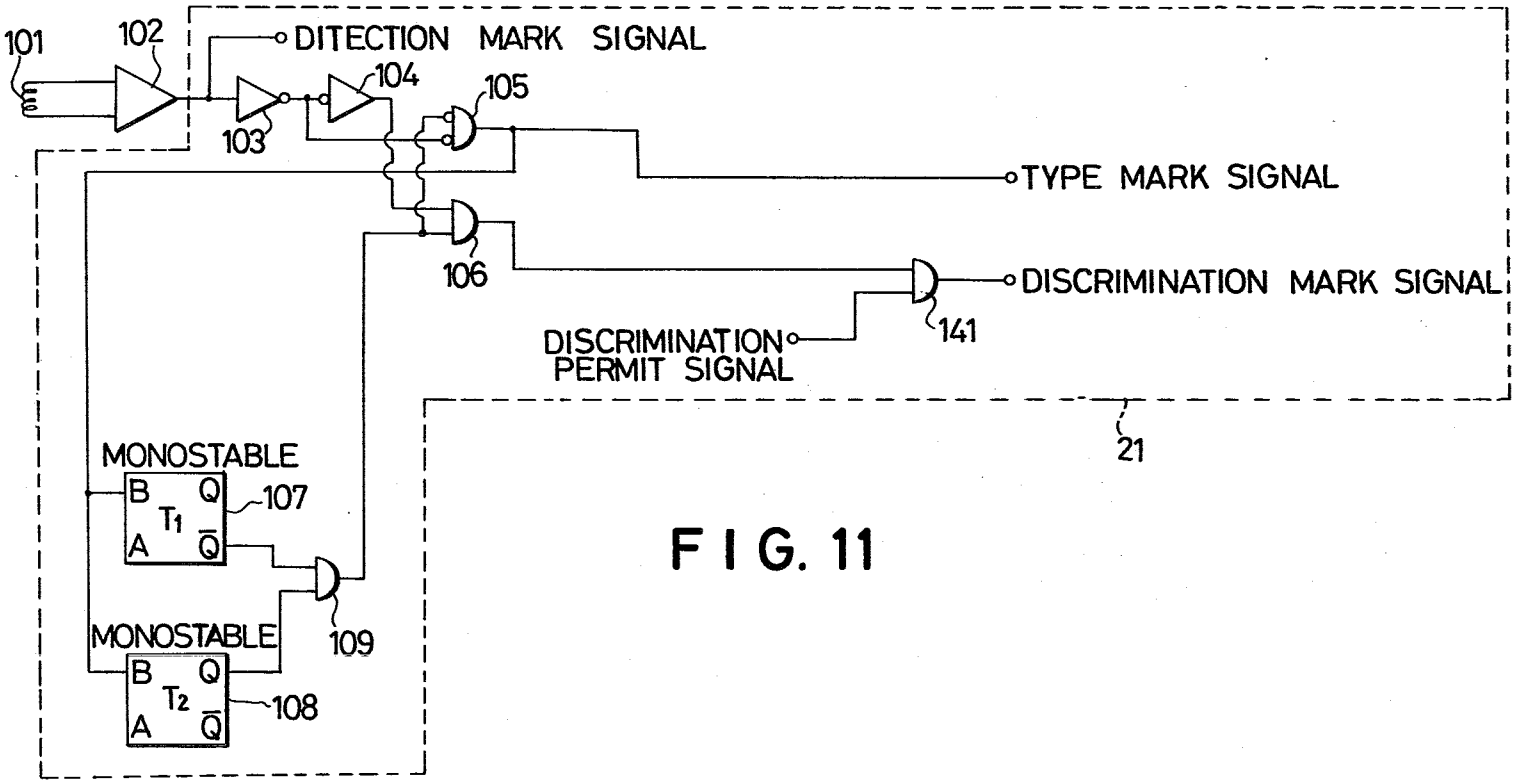
Figure 12:
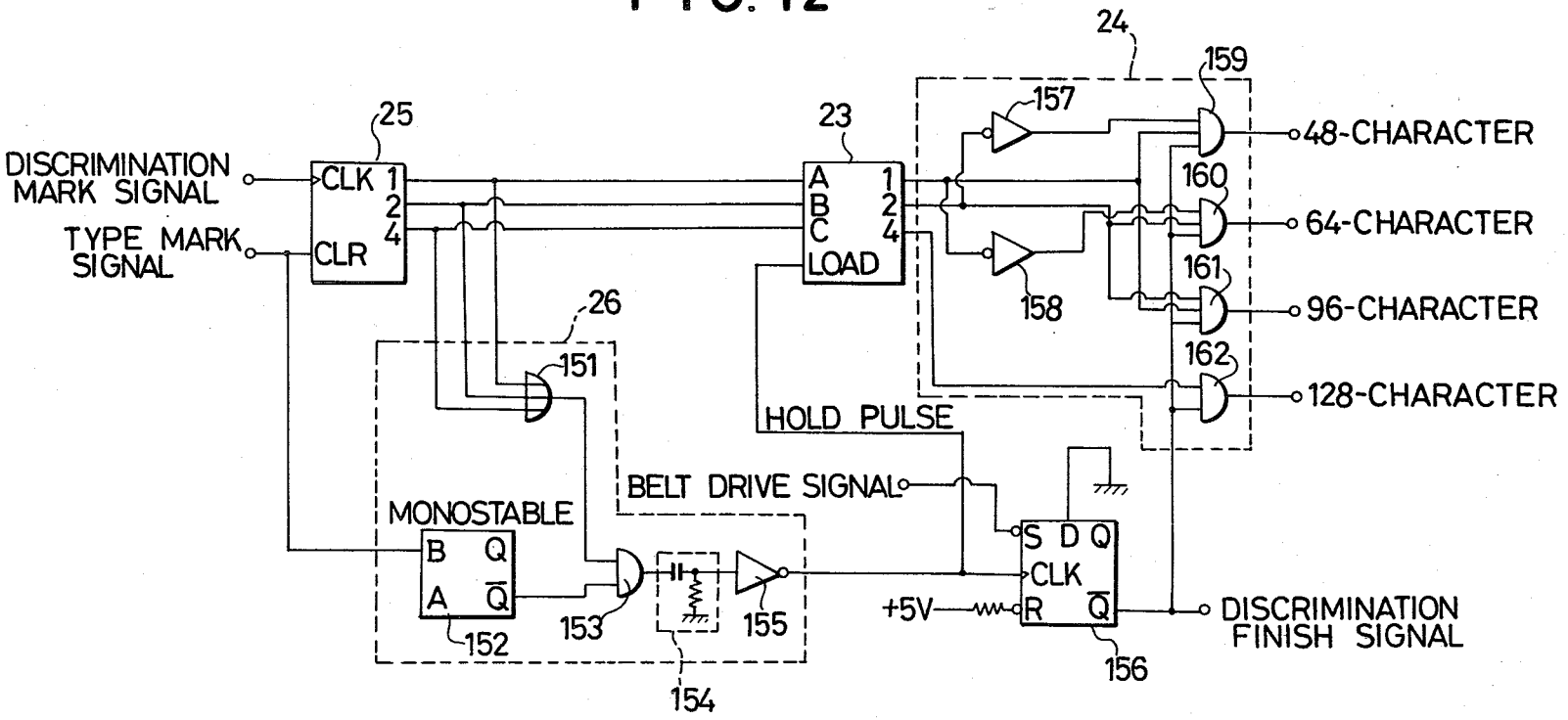
Figure 13A:
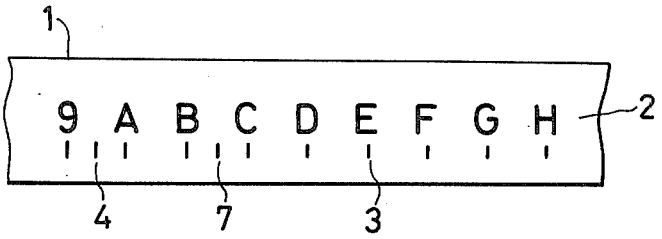
Figure 13B:
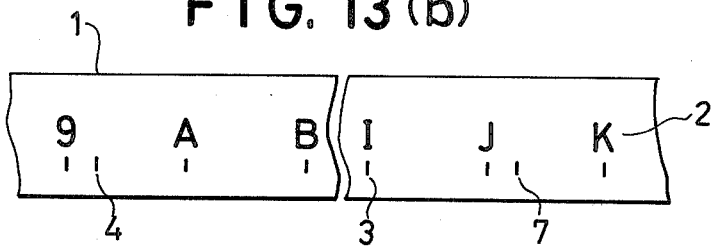
Figure 15:
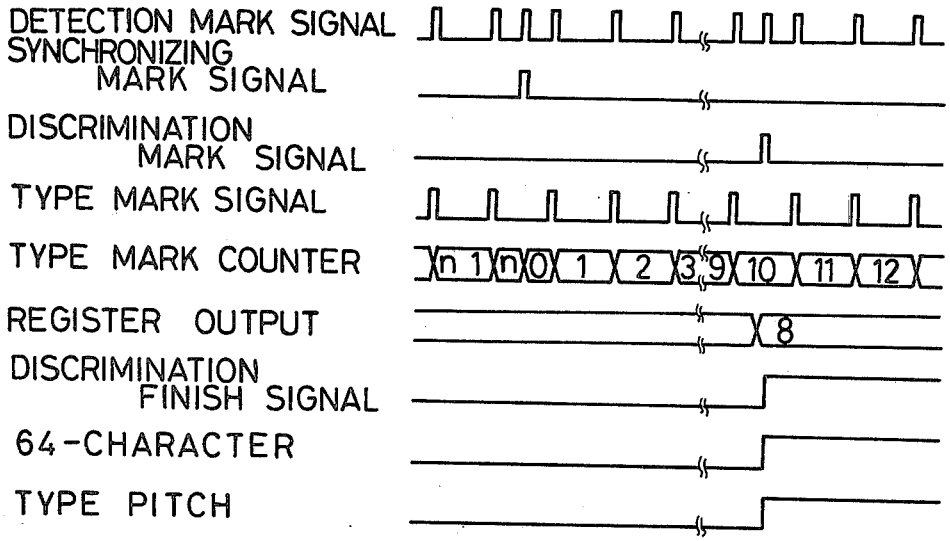
Figure 14:
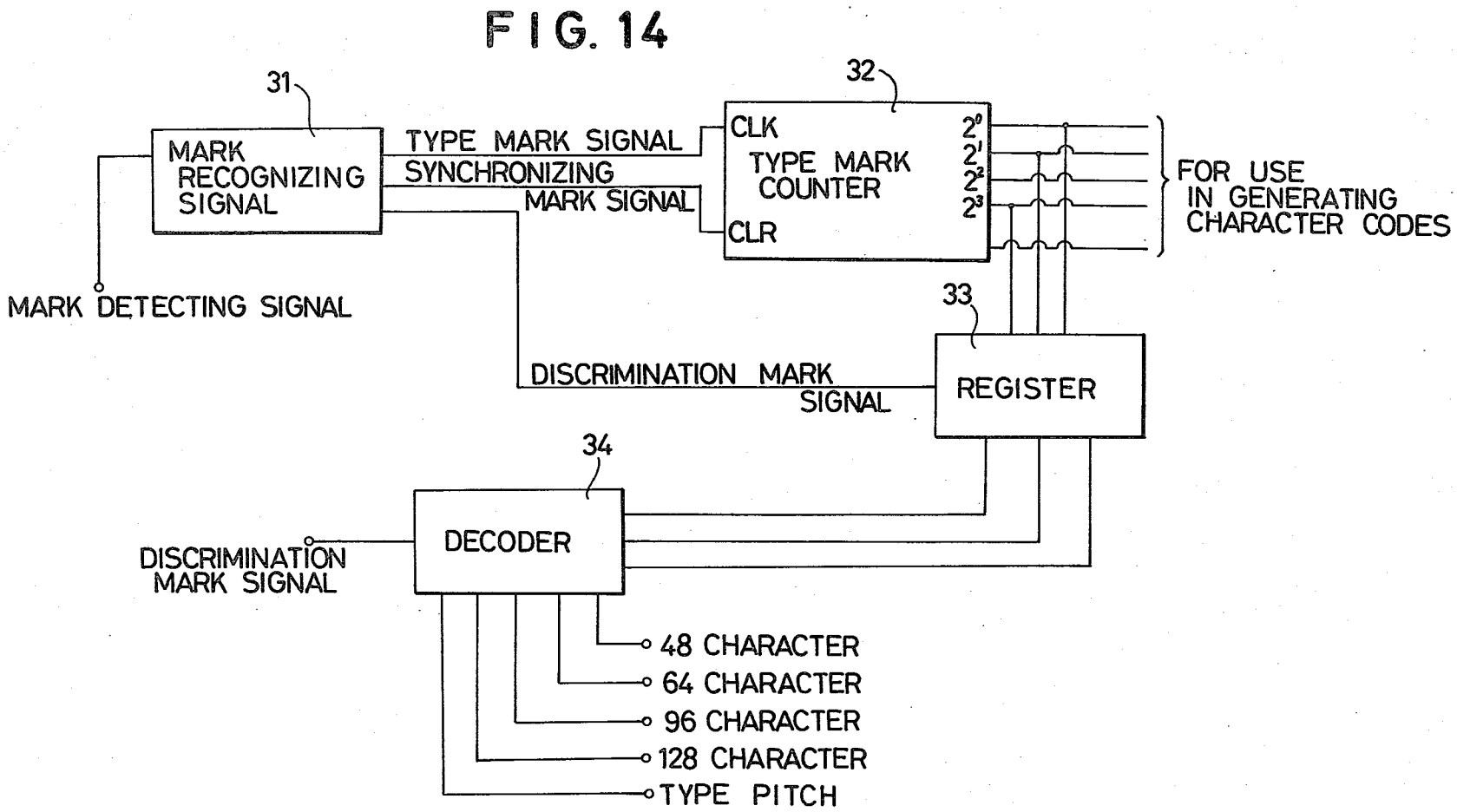

FIGS. 7(*a*)–7(*c*) are plan views of alternate type belts which may be used in the practice of the invention with slight modification of the first embodiment;

FIGS. 8(*a*)–8(*d*) are plan views of type belts of 48, 64, 96 and 128 characters, respectively, according to a second embodiment of the invention;

FIG. 9 is a block diagram of the discriminating circuit according to the second embodiment;

FIG. 10 is a timing diagram illustrating the operation of the discriminating circuit shown in FIG. 9;

FIG. 11 is a logic diagram of the mark recognizing circuit used in the discriminating circuit shown in FIG. 9;

FIG. 12 is a logic diagram of the discrimination mark counter, register, decoder and hold pulse generator used in the discriminating circuit shown in FIG. 9;

FIGS. 13(*a*) and 13(*b*) are plan views of type belts of higher and lower pitch, respectively, which may be discriminated according to another aspect of the invention;

FIG. 14 is a block diagram of the discriminating circuit according to the first embodiment modified to discriminate between higher and lower pitch type belts; and FIG. 15 is a timing diagram illustrating the operation of the discriminating circuit shown in FIG. 14.

DESCRIPTION OF THE PREFERRED EMBODIMENTS

FIGS. 1(*a*)–1(*d*) show various type belts. The type belts 1 shown in these figures have 48 different characters, 64 different characters, 96 different characters and 128 different characters, respectively. Type marks 3 are provided below types 2 on each type belt 1, respectively. The aforementioned synchronizing mark 4 is provided between the type marks 3 and on the same line of the type marks, and, furthermore, a discrimination mark 5 is also provided between the type marks 3 and on the same line of the type marks. The discrimination mark 5 is to determine the kind of a type belt 1. More specifically, the discrimination mark 5 is provided between the first and second type marks 3 from the synchronizing mark in the case of the type belt 1 having 48 different characters; it is provided between the second and third type marks 3 from the synchronizing mark 4 in the case of the type belt 1 having 64 different characters; it is provided between the third and fourth type marks 3 from the synchronizing mark 4 in the case of the type belt 1 having 96 different characters; and it is provided between the fourth and fifth type marks 3 from the synchronizing mark 4 in the case of the type belt 1 having 128 different characters. Thus, if the position of the discrimination mark 5 is detected by counting the number of type marks from the synchronizing mark 4, the kind of the type belt 1 can be discriminated.

Figure 1A:
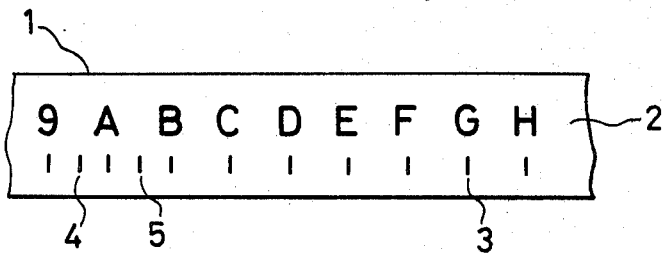
Figure 1B:
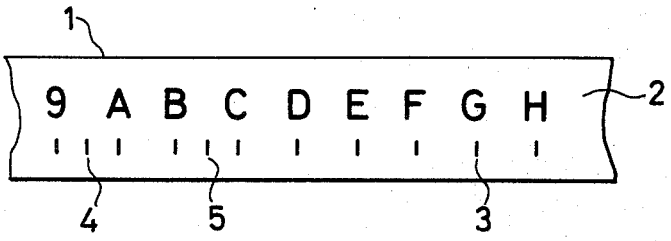
Figure 1C:
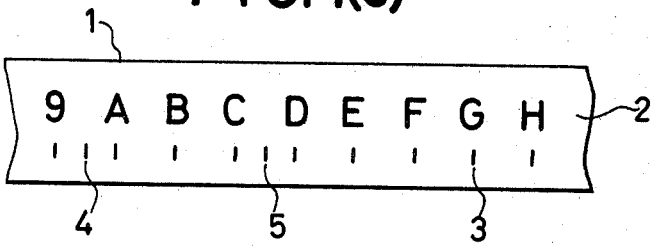
Figure 1D:
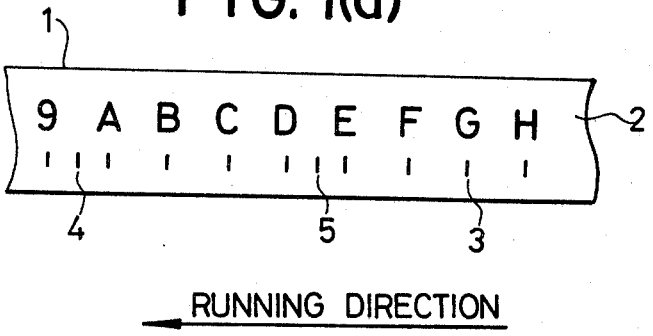
Figure 2:
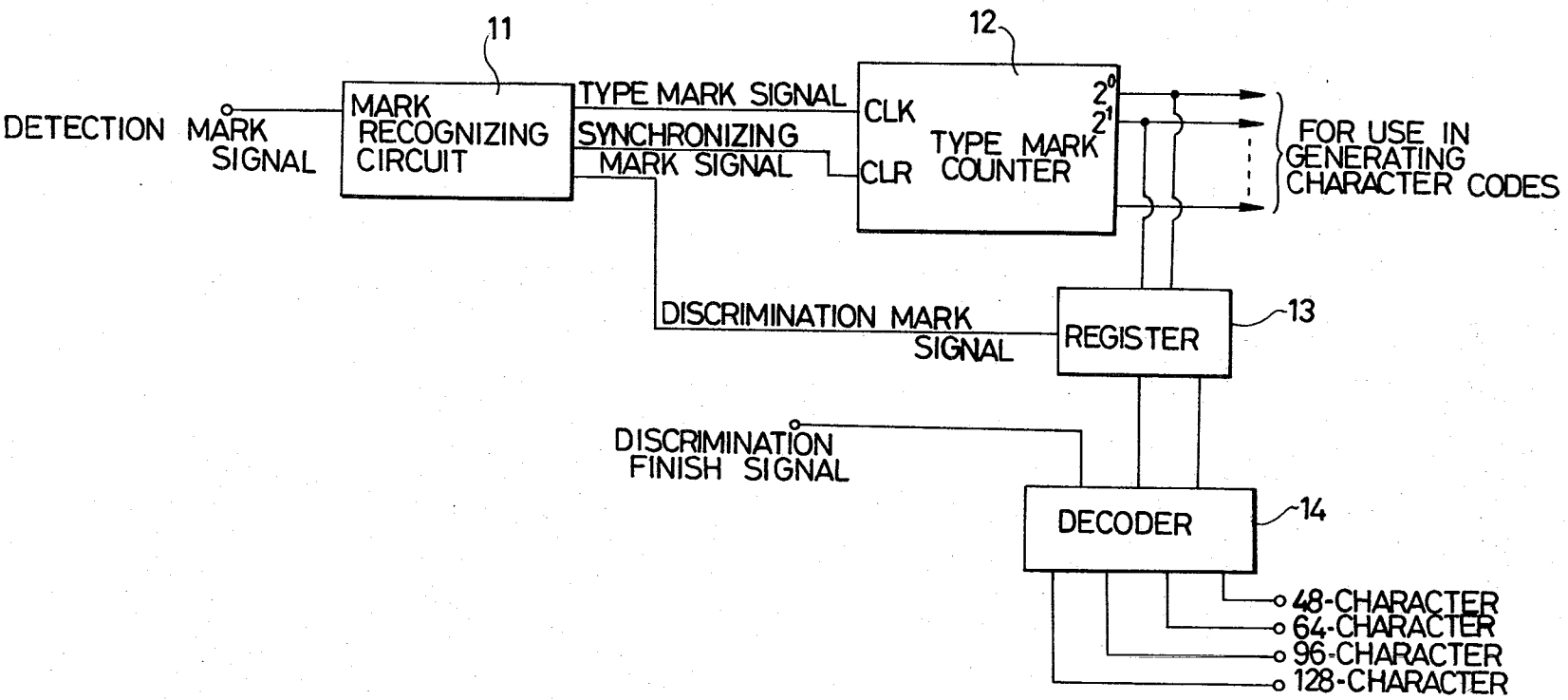
FIG. 2 is a block diagram of the discriminating circuit according to the first embodiment.

FIG. 2 is a block diagram illustrating one concrete example of a device for carrying out such discrimination. The type marks 3, the synchronizing mark 4 and the discrimination mark 5 are disposed on one and the same line. Therefore, even though they are detected by a mark detector, they cannot be distinguished from one another. Accordingly, the detection signals of the mark detector are recognized and classified into a type mark signal, a synchronizing mark signal and a discrimination mark signal by a mark recognizing circuit 11. The mark signals are classified by the mark recognizing circuit 11 by first recognizing the relative spacing and hence timing between type marks 3 and synchronizing and discrimination marks 4 and 5, and second recognizing the sequence or order of appearance of marks 4 and 5. This will be described in more detail with reference to FIG. 4 hereinbelow. The mark signals thus classified by the mark recognizing circuit 11 are supplied to counter 12 and register 13. The synchronizing mark signal clears a type mark counter 12, while the type mark signal is counted in the type mark counter 12. That is, the type mark counter 12 counts the number of type marks 3 detected by the mark detector after detection of a synchronizing mark 4. When the discrimination mark 5 is detected, the contents of the two lower significant bits of the output of the type mark counter 12 are stored in a register 13. The output of the register 13 is applied to a decoder 14 which provides one of four outputs indicating the kind of the type belt 1 descriminated. The output of the decoder 14 becomes effective after a discrimination finish signal is provided. This is to prevent an erroneous output when a correct discrimination operation is not carried out. The generation of the discrimination finish signal will also be described with reference to FIG. 4.

Figure 3:
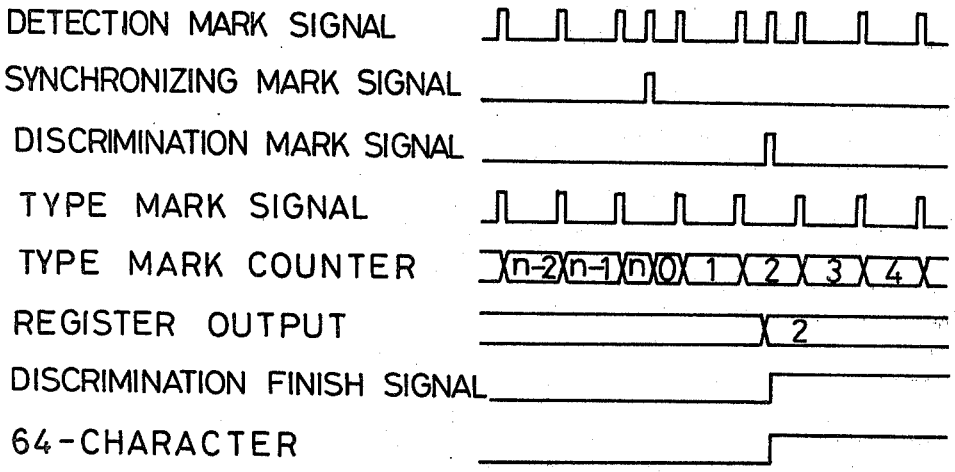
FIG. 3 is a timing diagram illustrating the operation of the discriminating circuit shown in FIG. 2.

FIG. 3 is a timing diagram representing the case of a type belt 1 having 64 different characters. After the synchronizing mark signal, the type mark signal occurs twice, and, therefore, the output of the type mark counter 12 is "2". If, in this case, the discrimination mark signal is provided, the two lower significant bits ("10" in binary notation) are stored in the register 13. The output of the register 13 is decoded by the decoder 14. When the discrimination finish signal indicating the finish of discrimination of the kind of a type belt is applied at the timing of the trailing edge of the discrimination mark signal, the output signal of the decoder becomes effective, as a result of which a signal line provided for the type belt having 64 characters become effective. In the case of the belt with 48 characters, the contents stored in the register 13 are "0 1"; in the case of the belt with 128 characters, the contents are "0 0". These make the signal lines of 48 characters, 96 characters and 128 characters effective to discriminate the respective type belts.

Figure 5:
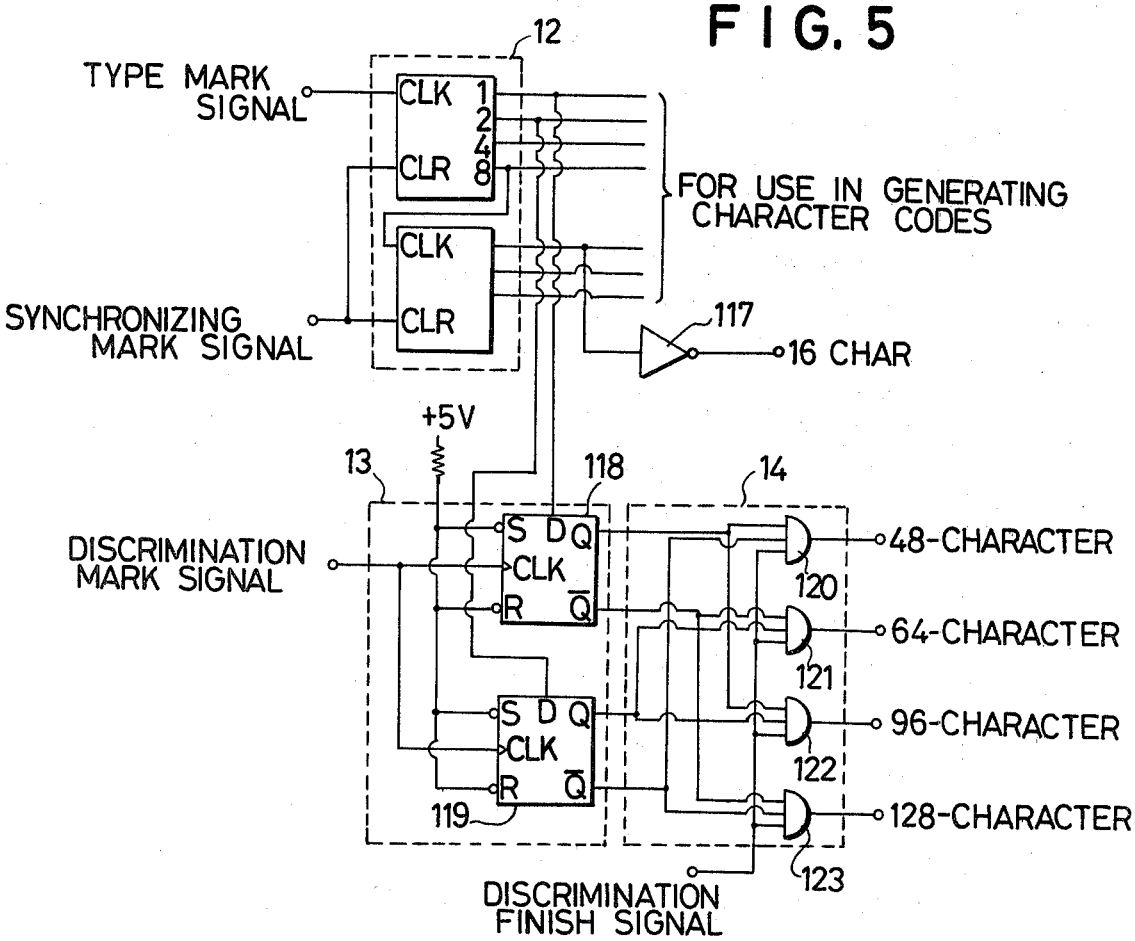
FIG. 5 is a logic diagram of the type mark counter, register and decoder used in the discriminating circuit shown in FIG. 2.
Figure 4:
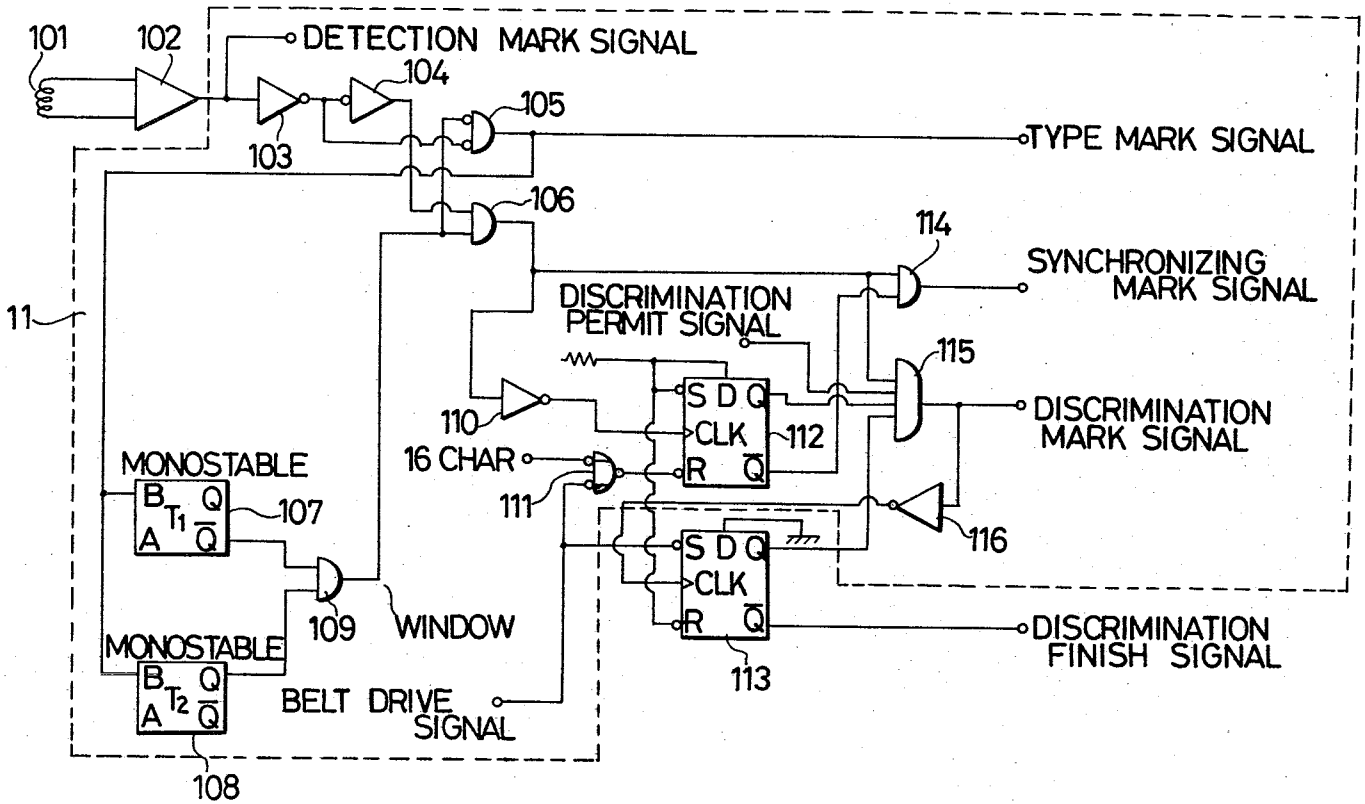
FIG. 4 is a logic diagram of the mark recognizing circuit used in the discriminating circuit shown in FIG. 2.
Figure 6:
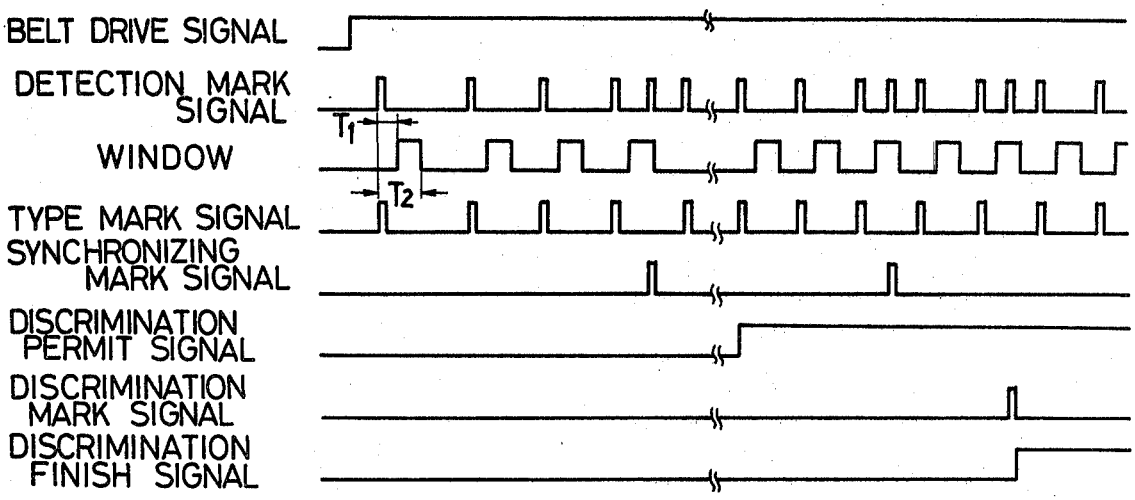
FIG. 6 is a timing diagram illustrating the operation of the logic circuitry shown in FIGS. 4 and 5.

FIGS. 4 and 5 are logic circuits illustrating a concrete example of the block diagram shown in FIG. 2. More specifically, FIG. 4 shows the mark recognizing circuit 11, while FIG. 5 shows the type mark counter 12, the register 13 and decoder 14. FIG. 6 is a timing diagram for a description of the operation of the logic circuit shown in FIG. 4. The belt drive signal shown in FIG. 6 has a logical value "1" which drives an electric motor (not shown) adapted to drive the type belt 1. The discrimination permit signal is a signal having a logical value "1" which is provided a predetermined period of time after the generation of the belt drive signal or after the travelling speed of the type belt 1 reaches a predetermined value, and it is required to correctly carry out mark signal recognition (described later); that is, the discrimination permit signal prevents the mark signal recognition before the type belt 1 reaches its predetermined speed. The 16-character (CHAR) signal is a signal having a logical value "0" which is provided through an inverter 117 (FIG. 5) when the type mark counter 12 counts 16 type mark signals. The mark detector 101 (FIG. 4) is a magnetic pickup such as that disclosed in U.S. Pat. No. 3,785,545. Therefore, whenever the above-described type mark 3 or synchronizing mark 4 or discrimination mark 5 on the type belt 1 is detected by the mark detector 101, a detection mark signal is outputted by an amplifier 102 connected to the mark detector 101.

The time constant $T_2$ of a monostable multivibrator 108 is so selected that it is larger than the time constant $T_1$ of a monostable multivibrator 107 but smaller than the period of the type mark signal obtained when the type belt 1 is successively rotatably moved at the predetermined speed. Accordingly, the detection mark signal provided during the period of time during which an AND gate 109 is open (the monostable multivibrator 107 is restored to be in a steady state, but the monostable multivibrator 108 is not restored to be in a steady state yet) passes through an AND gate 106, and it is determined as the synchronizing mark signal or the discrimination mark signal. On the other hand, the detection mark signal provided during the period of time during which the AND gate 109 is closed, passes through a negative logic AND gate 105, and it is regarded as the type mark signal. The first detection mark signal passing through the AND gate 106 is determined as the synchronizing mark signal by means of a flip-flop 112 and an AND gate 114. This detection mark signal is applied through an inverter 110 to the clock input terminal of the flip-flop 112 to change the state of the latter. If, after a detection mark signal has passed through the AND gate 106 but before the type mark counter 12 counts 16 type mark signals, there is a detection mark signal which passes through the AND gate 106, this detection mark signal is recognized as the discrimination mark signal with the aid of the flip-flop 112 and the AND gate 115. Upon detection of this discrimination mark signal, it is applied through an inverter 116 to a flip-flop 113, as a result of which the state of the flip-flop 113 is inverted by the trailing edge of the discrimination mark signal, and, therefore, the discrimination finish signal is produced. If there is no detection mark signal passing through the AND gate 106 during the time interval which elapses from the detection of the first detection mark signal which passed through the AND gate 106 until the type mark counter 12 counts 16 type mark signals, the discrimination mark signal is not produced, and, therefore, the discrimination is not finished. Accordingly, the flip-flop 112 is reset through negative logic NOR gate 111 by the aforementioned 16-character signal, and, therefore the detection mark signal which passes through the AND gate 106 next is regarded as the synchronizing mark signal again.

In other words, if, after a detection mark signal passes through the AND gate 106 but before the type mark counter 12 counts 16 type mark signals, a detection mark signal passes through the AND gate 106, then the former detection mark signal is determined as the synchronizing mark signal, and the latter detection mark signal is determined as the discrimination mark signal. In contrast, if no detection mark signal passes through the AND gate 106 before the type mark counter 12 counts 16 type mark signals, no discrimination mark signal is produced, and, therefore, the discrimination is not finished. Upon detection of the discrimination mark signal, it is applied to the clock input terminals of flip-flops 118 and 119 forming the register 13 shown in FIG. 5, as a result of which the information of the two lower significant bits of the type mark counter 12—that is, "0 1" in the case of 48 characters, or "1 0" in the case of 64 characters, and so forth—is stored in the flip-flops 118 and 119. Upon receipt of the discrimination finish signal, AND gate 120–123 forming the decoder 14 are enabled. That is, in the case of the type belt having 48 characters, the gate 120 is opened, thereby indicating that the type belt has 48 characters; in the case of the type belt having 64 characters, the AND gate 121 is opened, thereby indicating that the type belt has 64 characters, and so forth.

In the embodiment described above, the type belt 1 has the type marks 3, the synchronizing mark 4 and the discrimination mark 5 arranged on one line; however, these marks may be arranged as follows. As shown in FIGS. 7(*a*)–7(*c*), the synchronizing mark 4 and the discrimination mark 5 are provided on different lines, respectively, or they may be arranged on one line, with the type marks on another line. However, if the marks 3, 4 and 5 are arranged on one end and the same line as described before, detection of the marks can be achieved by only one mark detector, which contributes to simplification of the mechanical arrangement of the device.

FIGS. 8(*a*)–8(*d*) show another example of the type belt to which the discrimination system according to this invention is applied. In this case, a discrimination mark 6 serves not only as a discrimination mark but also as a synchronizing mark. The discrimination mark 6 and the type marks 3 are provided on one and the same line. FIGS. 8(*a*)–8(*d*) show type belts 1 having 48 different characters, 64 different characters, 96 different characters and 128 different characters, respectively. As is apparent from FIGS. 8(*a*)–8(*d*), one discrimination mark 6 is provided on the type belt with 48 characters; two discrimination marks 6 on the type belt with 64 characters; three discrimination marks 6 on the type belt with 96 characters; and four discrimination marks on the type belt with 128 characters. Therefore, the kind of the type belt can be discriminated by counting the number of discrimination marks 6.

FIG. 9 is a block diagram illustrating one example of a device adapted to carry out such discrimination. Detection mark signals obtained by detecting the type mark 3 and the discrimination mark or marks 6 are classified into a type mark signal and a discrimination mark signal by means of a mark recognizing circuit 21. Upon detection of the type mark signal, a discrimination mark counter 25 is cleared while a hold pulse generator 26 is operated. After a type mark signal is detected, the hold pulse generator 26 outputs a pulse adapted to store the contents of the discrimination mark counter 25 in a register 23 during a period of time longer than a period of time for generating all the discrimination mark signals but before the provision of the following type mark signal. This pulse is generated only when the contents of the discrimination mark counter 25 are not "0". The output of the register 23 is applied to a decoder 24, where the kind of the type belt is determined. The output of the decoder 24 is not made effective before discrimination of the kind of the type belt is finished—that is, it becomes effective when the discrimination finish signal is provided. This is again to prevent an erroneous character set discrimination signal from being produced.

FIG. 10 is a timing diagram representing the case of a type belt 1 having 64 different characters. When the first discrimination mark signal is provided after the generation of the type mark signal, a value "1" is added in the discrimination mark counter 25 which has been cleared by the type mark signal, and, therefore, the output thereof is "0 0 1" in binary notation. The discrimination mark signal clears the contents of the type mark counter 22. When the second discrimination mark signal occurs, a value "1" is added to the count value of the discrimination mark counter 25, and, therefore, the output thereof becomes "0 1 0" in binary notation. Thereafter, when the hold pulse is outputted by the hold pulse generator 26, the contents of the discrimination mark counter 25 are stored in the register 23. The output of the register 23 is decoded, and when the discrimination finish signal is available, the signal line specifying the type belt having 64 characters is activated. Data stored in the register 23 in the case of the type belt having 48 characters are "0 0 1", while data stored in the register 23 in the case of the type belt having 96 characters are "0 1 1". Furthermore, in the case of type belt having 128 characters, data stored in the register 23 and "1 0 0". These data activate the signal lines specifying the type belts having 48, 96 and 128 characters, respectively.

FIGS. 11 and 12 are logic diagrams concretely illustrating the circuitry shown in the block diagram of FIG. 9. More specifically, FIG. 11 shows the above-described mark recognizing circuit 21, and FIG. 12 shows the discrimination mark counter 25, the hold pulse generator 26 and the decoder 24. In FIGS. 11 and 12, those components which have been previously described with reference to FIGS. 4 and 5 have, therefore, been similarly numbered. As in the case of FIG. 4, the detection mark signal which passes through an AND gate 106 while an AND gate 109 is open is regarded as the discrimination mark signal, and it is allowed to pass through an AND gate 141 upon application of the above-described discrimination permit signal thereto. The discrimination mark signal is applied to the clock input terminal of the discrimination mark counter 25, which is cleared by the type mark signal, where it is counted. The hold pulse generator 26 comprises a monostable multivibrator 152 which is triggered by the type mark signal and has a time constant shorter than the period of the type mark signal obtained when the type belt 1 successively rotatably moves at a predetermined speed but longer than the period of time during which all the discrimination mark signals occurs. An OR gate 151 provides the logical sum of the output of the discrimination mark counter 25. An AND gate 153 provides the logical product of the output of the OR gate 151 and the "0" side output of the monostable multivibrator 152. A differentiation circuit 154 differentiates the output of the AND gate 153, and the differentiated output is inverted by inverter 155. The output of the hold pulse generator, or the output of the inverter 155, is the hold pulse. The hold pulse is applied to the load input terminal of the register 23 and to the clock input terminal of a flip-flop 156. Accordingly, upon provision of the hold pulse, the number of the discrimination mark signals, or the number of the discrimination marks 6, counted by the discrimination mark counter 25 (one for the type belt of 48 characters; two for the type belt of 64 characters; and so forth) is stored in the registor 23, while the state of the flip-flop 156 is changed, as a result of which the discrimination finish signal is generated. The decoder 24 comprises inverters 157 and 158 and AND gate 159–162 as shown in FIG. 12. Upon provision of the discrimination finish signal, one of the AND gates 159–162 is opened according to the number of discrimination marks 6, discriminating the kind of the type belt in question. More specifically, in the case of the type belt having 48 characters, an AND gate 159 is opened, in the case of the type belt having 64 characters, the AND gate 160 is opened, and so forth.

FIGS. 13(*a*)–13(*b*) show type belts 1 which are different in the distance between adjacent characters (hereinafter referred to as "type pitch"). More specifically, FIG. 13(*a*) shows a type belt 1 higher in type pitch, while FIG. 13(*b*) shows a type belt 1 lower in type pitch; however, both of the type belts 1 have 64 characters. On the type belt 1 higher in type pitch, a discrimination mark 7 is provided between the second type mark 3 and the third type mark 3 from the synchronizing mark 4. On the other hand, on the type belt 1 lower in type pitch, a discrimination mark 7 is provided between the tenth type mark 3 and the eleventh type mark 3 from the synchronizing mark.

FIG. 14 is a block diagram illustrating a concrete example of a device capable of discriminating the type pitch and the number of types simultaneously. Since the device shown in FIG. 14 is substantially similar to that in FIG. 2, the detailed description thereof will be omitted. When the discrimination mark 7 is detected, the output bits $2^0$, $2^1$ and $2^3$ of a type mark counter 32 are stored in a register 33—that is, the data "0 1 0" is stored therein in the case of the former type belt 1 higher in type pitch, the data "1 1 0" is stored therein in the case of the latter type belt 1 lower in type pitch. The two lower significant bits "1 0" of the data indicate that the type belt has 64 characters. If the most significant bit is "0", then the type belt 1 is higher in type pitch; and if it is "1", then the type belt 1 is lower in type pitch. With the type belt 1 lower in type pitch, when the discrimination mark 7 is detected, "6" is stored in the register 33 as indicated in FIG. 15. ( Although the output of the type mark counter 32 is "1 0", "6" is provided because the bit $2^2$ is disregarded. ) The output of the register 33 is applied to a decoder 34, whereby discrimination of the type pitch and the kind of the type belt is carried out. As a result, the signal line specifying the type belt having 64 characters is activated, while the signal line specifying the type pitch is also activated. This means that the type belt 1 is lower in type pitch and has 64 characters.

As is apparent, in this invention, it is not required to count all the type marks on the type belt. Accordingly, errors in discrimination can be minimized, and the time required for discrimination can be reduced. Furthermore, since the count value of the counter adapted to detect the position of the discrimination mark or the number of discrimination marks is small, the arrangement of the counter can be simplified. These are the significant merits of the invention.

What is claimed is:

1. In a printer provided with one of a plurality of interchangeable type carriers, each of said interchangeable type carriers having a predetermined number of characters thereon, and a corresponding group of type marks, the improvement characterized by a system for discriminating among said plurality of interchangeable type carriers comprising:

(a) a synchronizing mark provided on said type carrier at a first preselected position proximate to a first type mark;

(b) a discrimination mark provided on said type carrier at a second preselected position proximate to a second type mark displaced a preselected number of type marks from said first type mark;

(c) means for sensing said synchronizing mark, said type marks, and said discrimination mark and for separating out a sensed synchronizing mark, sensed type marks, and a sensed discrimination mark; and (d) means responsive to said sensing and separating means for counting the number of type marks between said sensed synchronizing mark and said sensed discrimination mark, said number of type marks counted being indicative of the number of characters on said type carrier, and means for decoding said count of said number of type marks to provide an output signal indicative of said predetermined number of characters on said interchangeable type carrier being used; said interchangable type carriers further being of either a high pitch or a low pitch, said discrimination mark being provided on said type carrier at one of two preselected positions for any given number of characters on said type carrier depending on the pitch of the characters, and wherein said counting means and said decoding means includes:

(1) first counter means having a clock input responsive to said sensed type marks and a clear input responsive to said sensed synchronizing mark for providing a binary count signal of said clock input signal;

(2) register means having inputs responsive to a first preselected group of least significant bits and to the most significant bit of said binary count signal of said first counter means and a grate input responsive to said sensed discrimination mark for providing at an output said first preselected group and said most significant bit of said binary count signal when said sensed discrimination mark is present; and (3) decoder means responsive to said output of said register means for providing at least one of a plurality of output signals corresponding to said binary state of said output from said register means, whereby the predetermined characters and the type pitch of said interchangable type carrier is indicated.

* * * * *